US006116380A

United States Patent [19]

Wang

[11] Patent Number: 6,116,380

[45] Date of Patent: Sep. 12, 2000

[54] ELEVATOR PROVIDED WITH EMERGENCY ESCAPE

[76] Inventor: chiu nan Wang, No. 50, Alley 97, Lane 354, Sanher Rd., Fengyuan, Taichung County, Taiwan

[21] Appl. No.: 09/208,634

[22] Filed: Dec. 8, 1998

[51] Int. Cl.[7] ..... B66B 11/08

[52] U.S. Cl. ..... 187/263; 187/350

[58] Field of Search ..... 187/350, 266, 187/263, 277; 188/65.1

[56] References Cited

U.S. PATENT DOCUMENTS

| | | | |
|---|---|---|---|
| 2,145,656 | 1/1939 | Hymans | 187/350 |
| 5,680,911 | 10/1997 | Wang | 187/350 |
| 5,713,433 | 2/1998 | Wang | 187/350 |
| 5,890,565 | 4/1999 | Wang | 187/350 |

FOREIGN PATENT DOCUMENTS

| | | | |
|---|---|---|---|
| 001477925 | 4/1967 | France | 187/350 |
| 001522138 | 4/1968 | France | 187/350 |
| 000704739 | 4/1966 | Italy | 187/350 |
| 000223308 | 10/1924 | United Kingdom | 187/350 |

*Primary Examiner*—Robert P. Olszewski
*Assistant Examiner*—Steven B. McAllister
*Attorney, Agent, or Firm*—Pro-Techtor International Services

[57] ABSTRACT

An elevator is provided with an emergency escape device consisting of a pull cable capable of bringing about the disengagement of a brake with a transmission shaft of a planetary deceleration motor, so as to actuate an action wheel to displace axially. A worm rod is actuated by an action cable such that the worm rod drives a worm wheel unidirectionally, thereby resulting in the actuation of the action wheel by the transmission wheel. The transmission shaft is so linked that the cable wheel is actuated to cause the elevator cab to ascend or descend slowly to reach a safe level to enable the elevator passengers to escape.

2 Claims, 14 Drawing Sheets

FIG, 8

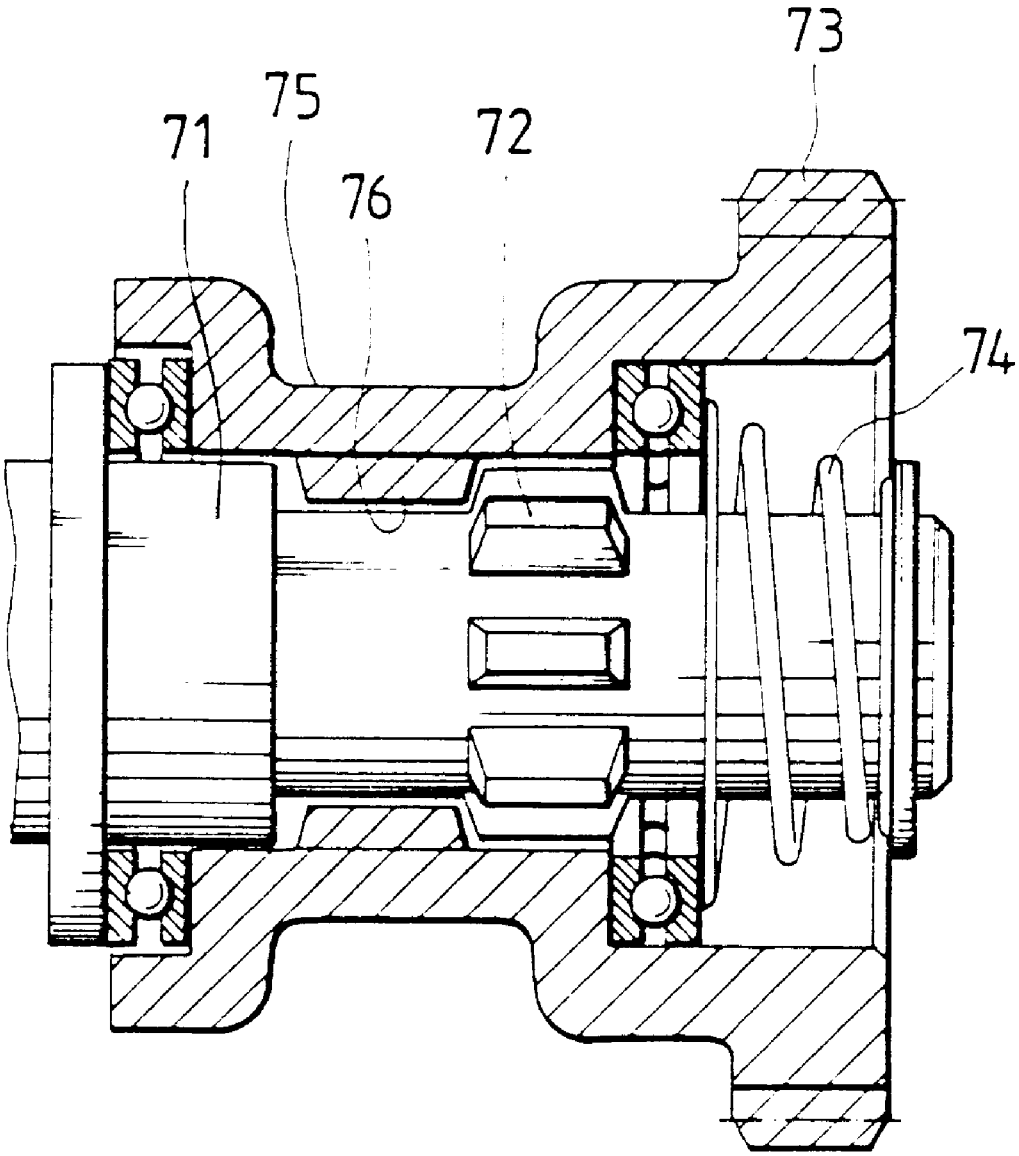
FIG ,10

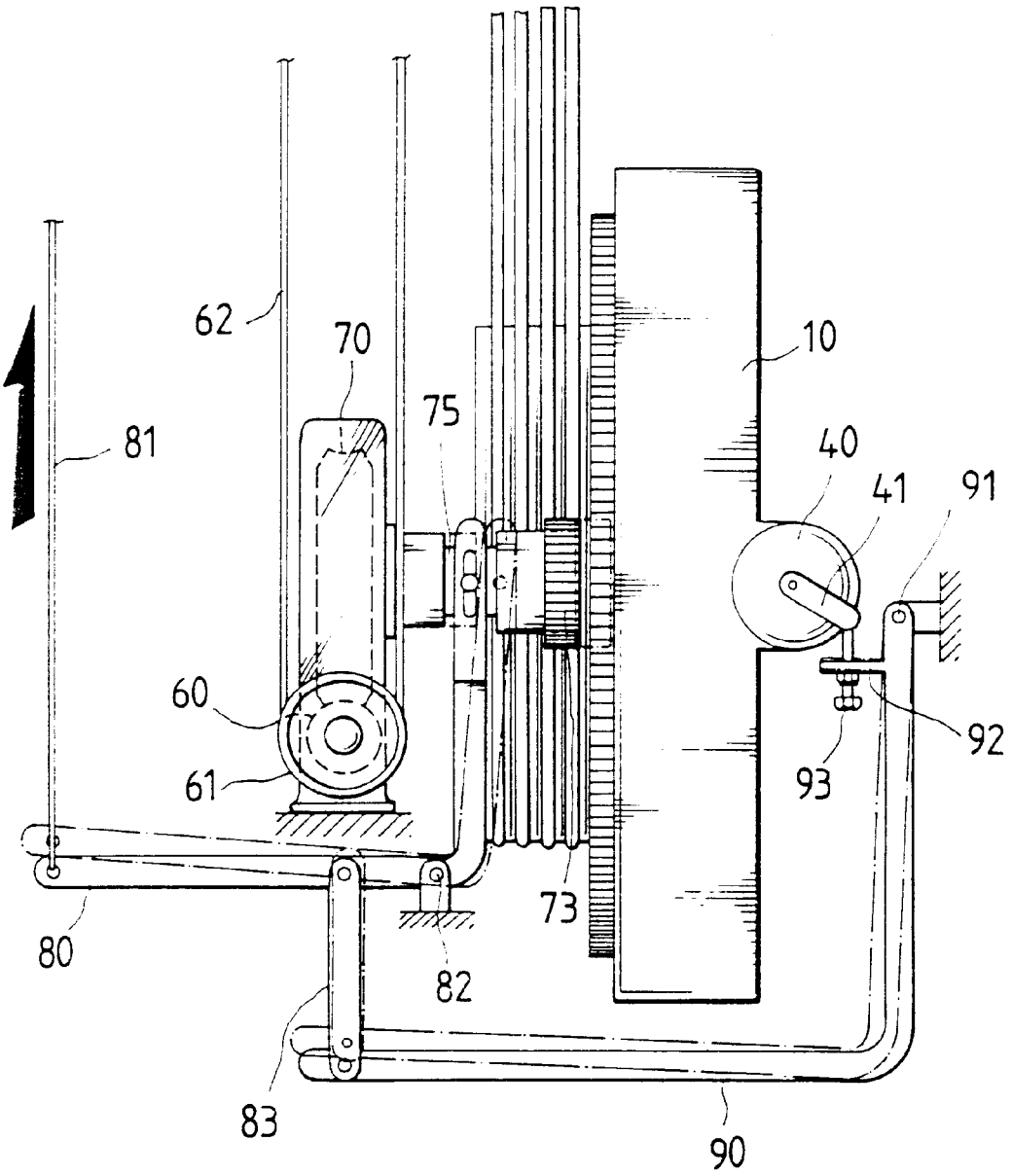
FIG, 11

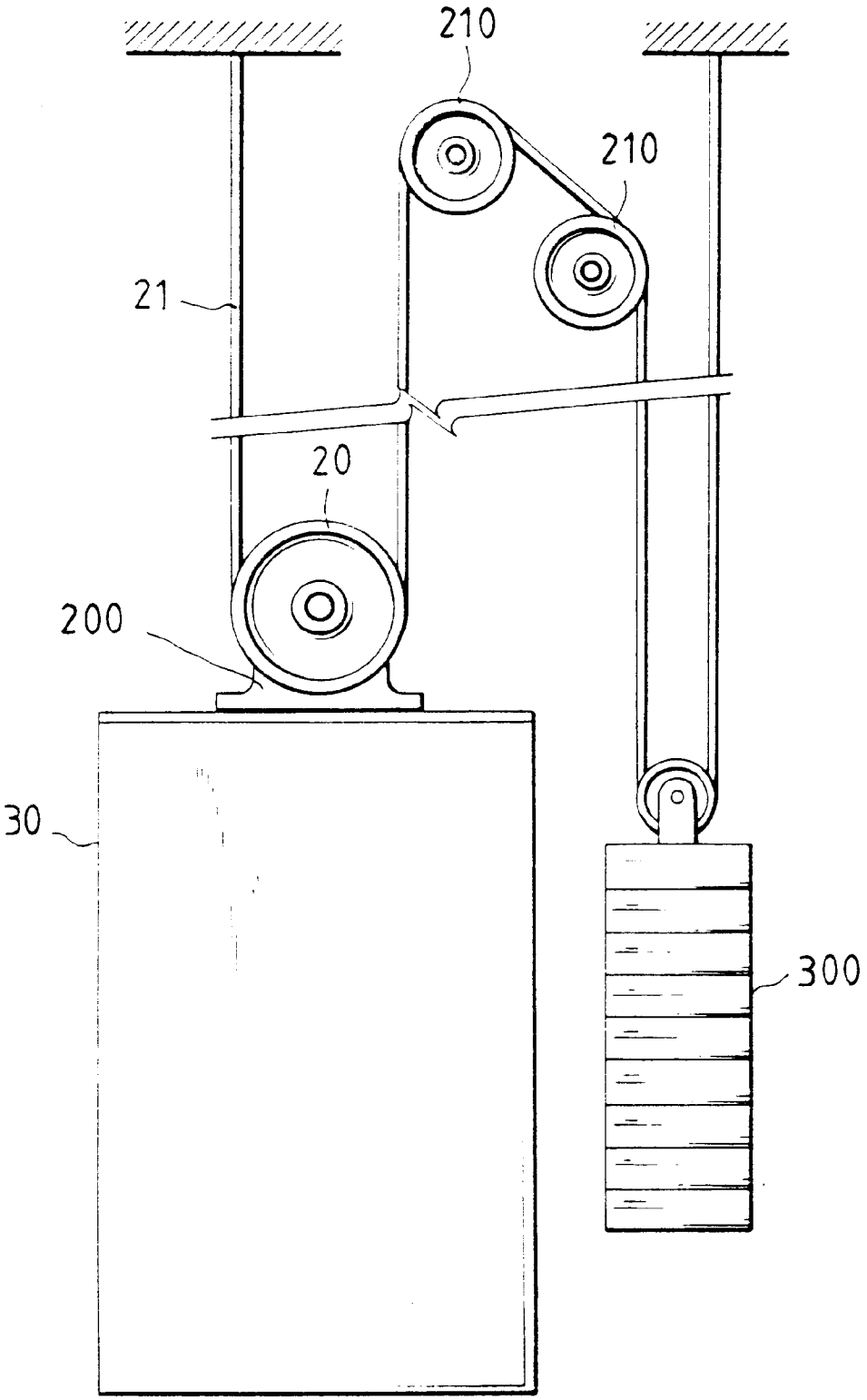
FIG ,12

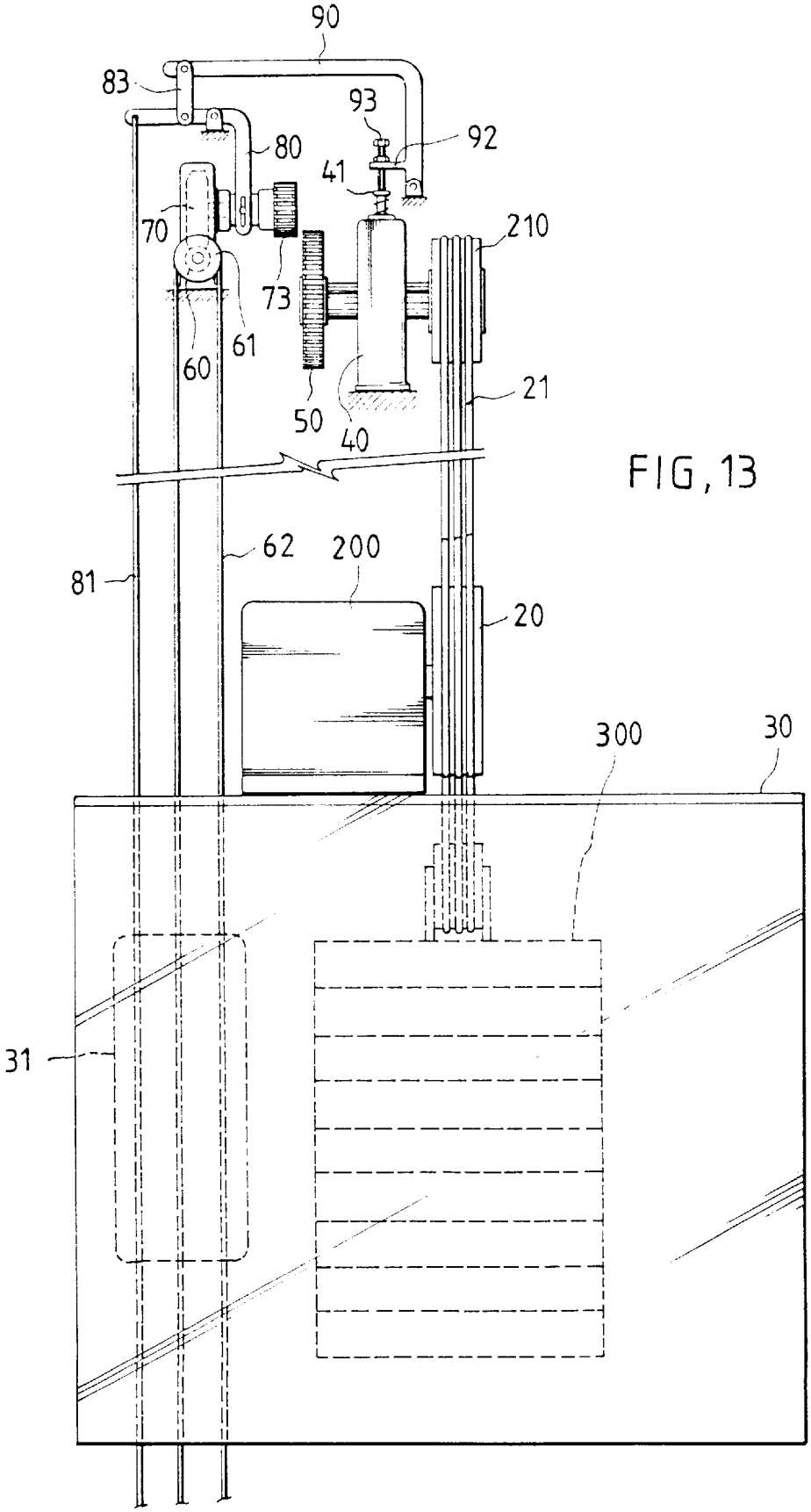
FIG, 13

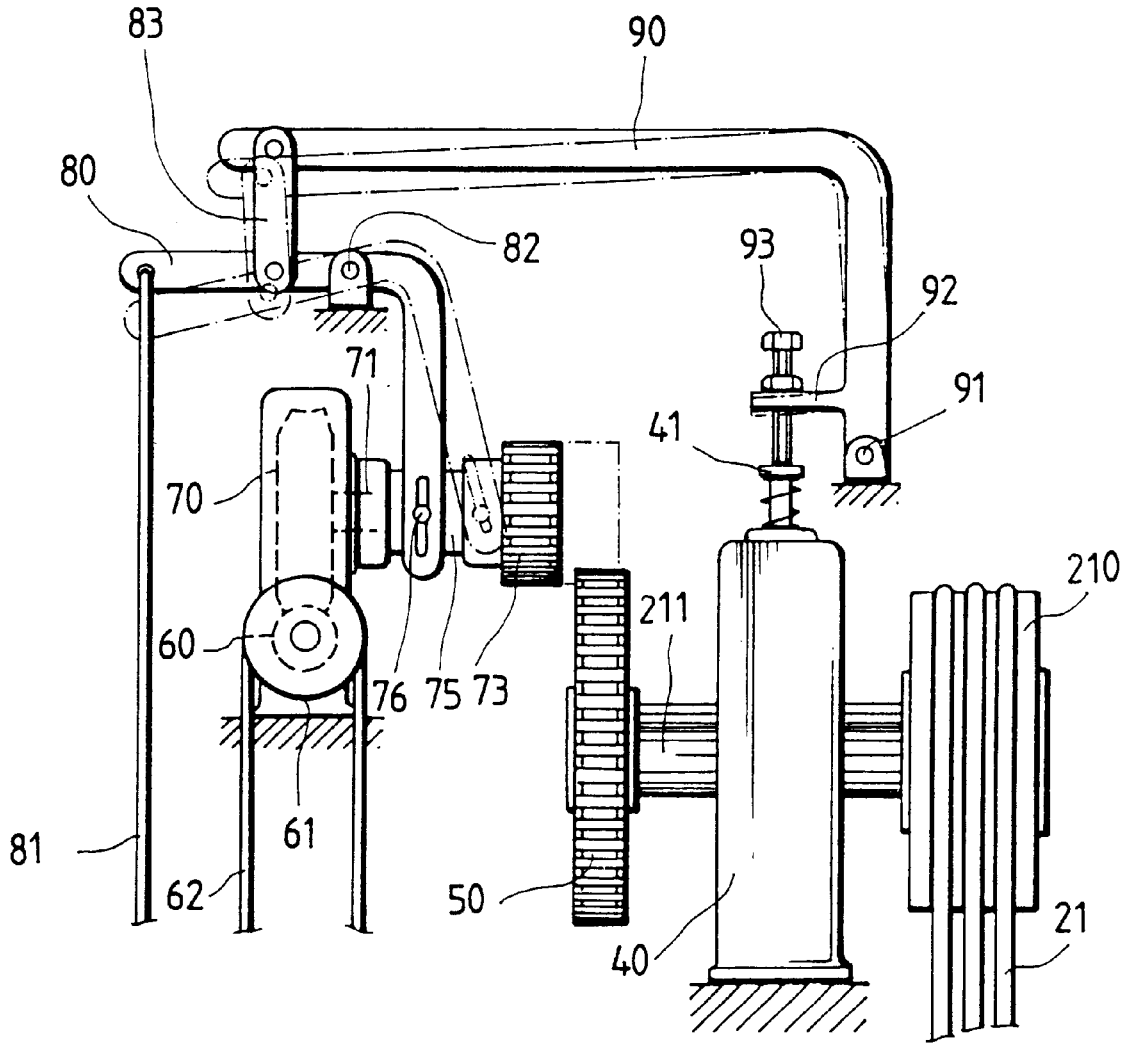
FIG, 14

ELEVATOR PROVIDED WITH EMERGENCY ESCAPE

FIELD OF THE INVENTION

The present invention relates generally to an elevator, and more particularly to an emergency escape of the elevator.

BACKGROUND OF THE INVENTION

The conventional elevator is generally provided with an emergency escape consisting of an action rod which is mounted on a braking device of a motor transmission shaft located in the control room of the elevator. The action rod is provided with an application rod such that the action rod can be actuated by the application rod to swivel, and that the application rod is fastened at other end thereof with a pull cord. The application rod is further provided in the midsegment thereof with a rotary wheel on which an action cord is wound. A transmission wheel is mounted by the rotary wheel. A support rod is provided by the transmission wheel. The transmission wheel is capable of turning along with the rotary wheel. The application rod is actuated by the pull cord to swivel downward so as to actuate the transmission wheel to actuate the action wheel to turn. As the action rod is actuated, the brake shoes of the braking device become disengaged with the transmission shaft of the motor. The transmission wheel actuates the action wheel which is linked with the transmission shaft of the motor, thereby resulting in the operation of the component parts of a transmission box and the elevator cab. In case of a emergency, such as a power outage, the braking effect is relieved of by the pull cable such that the action wheel is driven by the transmission wheel, thereby resulting in the operation of the transmission shaft of the motor. The elevator cab can be either moved up or down by the operation of the large gear and the pinion of the transmission box. In order to stabilize the elevator cab, the elevator cab is provided with a weight which can bring about a reaction force at the time when the transmission shaft of the motor is relieved of the braking force. As a result, the traveling speed of the elevator cab can be out of control.

SUMMARY OF THE INVENTION

The primary objective of the present invention is to provide an elevator with an emergency escape consisting of a pull cable capable of bringing about the disengagement of a braking device with the transmission shaft of a planetary deceleration motor, so as to actuate an action wheel to displace. A worm rod is actuated by an action cable such that the worm rod drives a worm wheel unidirectionally, thereby resulting in the actuation of the action wheel by the transmission wheel. The transmission shaft can be so linked that the cable wheel is actuated to cause the elevator cab to ascend or descend slowly to reach a safe level to enable the passengers to escape.

The present invention will be more readily understood upon a thoughtful deliberation of the following detailed description of a preferred embodiment of the present invention with reference to the accompanying drawings.

BRIEF DESCRIPTION OF THE DRAWINGS

FIG. 10 shows a partial section view of the present invention in operation in conjunction with the butterfly motor.

FIG. 11 shows a schematic view of the present invention in operation in conjunction with the butterfly motor.

FIG. 12 shows a schematic view of an elevator cab provided with a frequency changing motor.

FIG. 13 shows a side schematic plan view of the present invention in conjunction with the elevator cab which is provided with the frequency changing motor as shown in FIG. 12.

FIG. 14 shows a partial enlarged schematic view of the present invention of FIG. 13 is action.

DETAILED DESCRIPTION OF THE INVENTION

Figure 1:
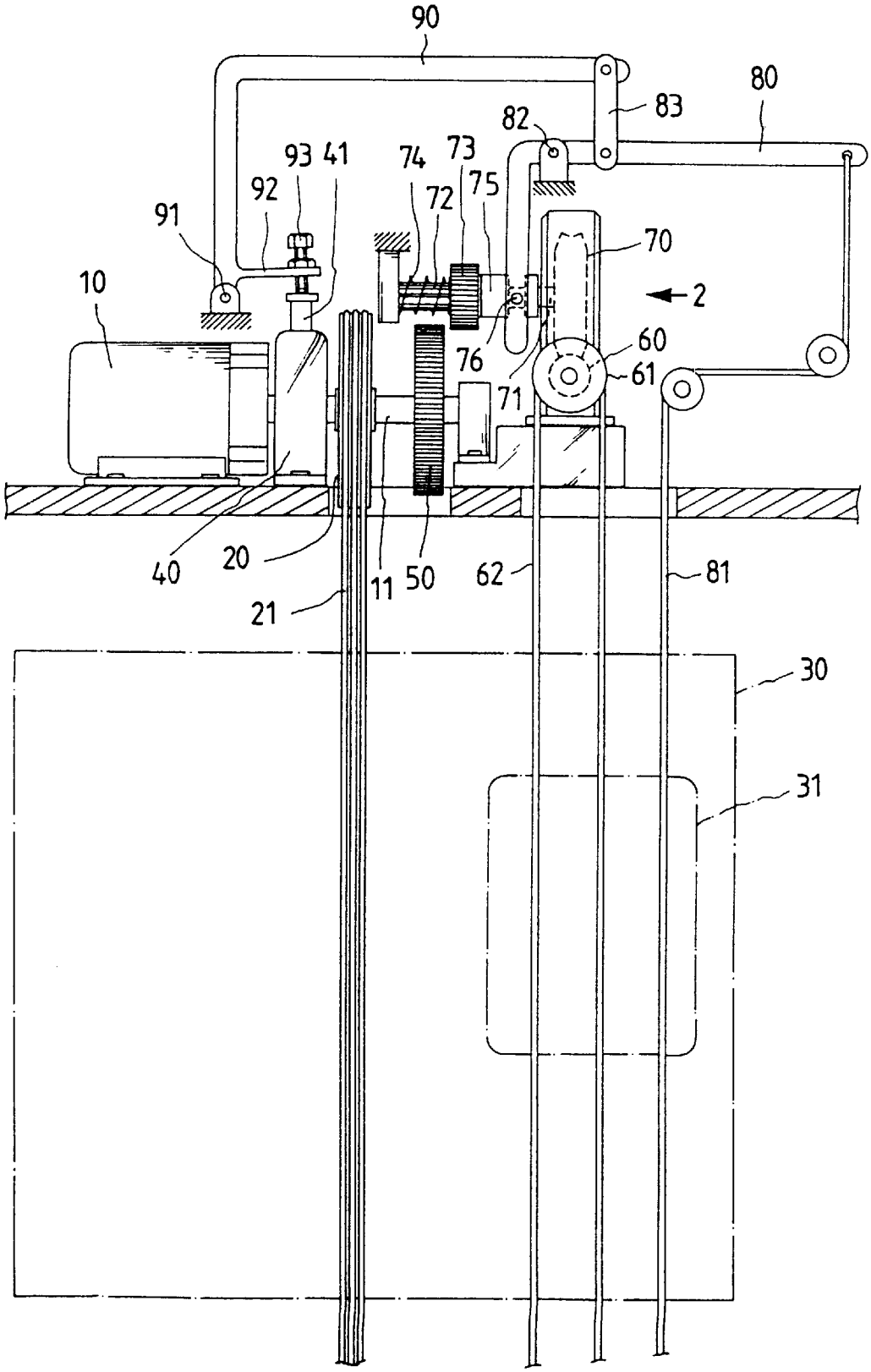
FIG. 1 shows a schematic plan view of the present invention.
Figure 2:
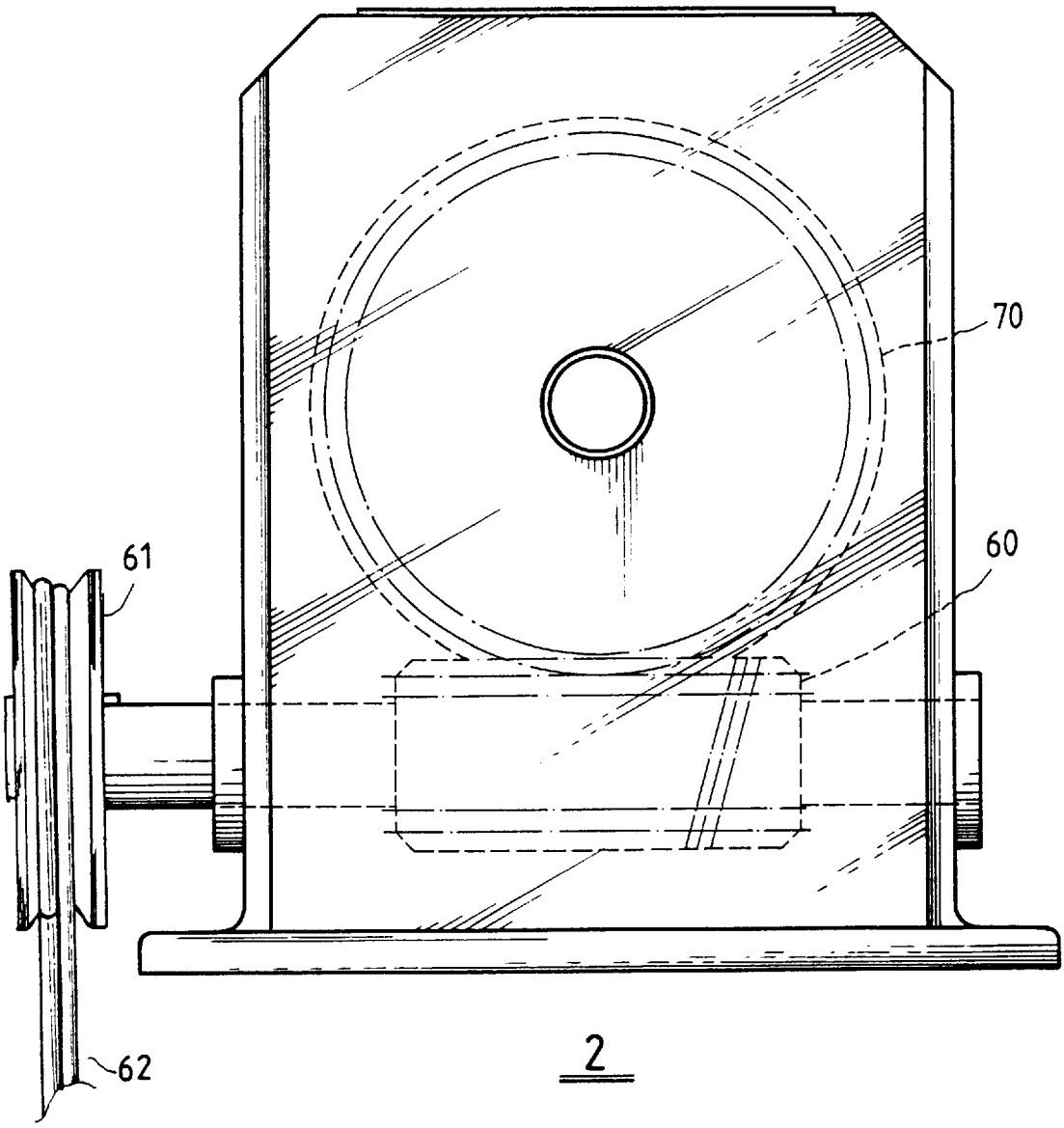
FIG. 2 shows a partial side view of the present invention.
Figure 3:
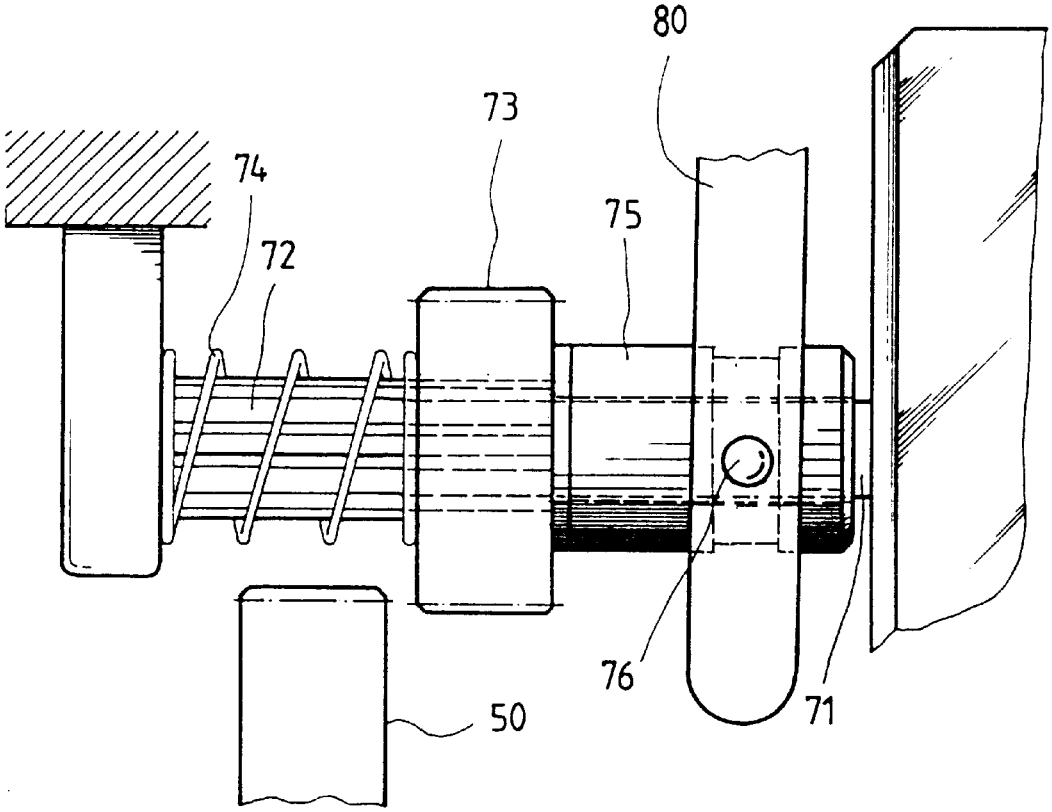
FIG. 3 shows a partial enlarged view of the present invention.

As shown in FIGS. 1–3, a planetary deceleration motor 10 is mounted in an elevator mechanical control room to serve as a main power source for the elevator cab to ascend and descend. The motor 10 is provided with a transmission shaft 11 which is linked with an ascending-descending cable wheel 20. An elevator cab 30 is actuated by a cab cable wheel 20. An elevator cab 30 is actuated by a cab cable 21 which is in turned actuated by the cable wheel 20. The transmission shaft 11 is provided with a brake 40 and an action wheel 50 which is provided with a driving and protecting structure.

The driving and protecting structure is provided with a worm rod 60 which is provided at one end thereof with a rotary wheel 61 on which an action cable 62 is wound. The worm rod 60 is engaged with a worm wheel 70 having a link shaft 71. The link shaft 71 is provided with a spline 72. A transmission wheel 73 is mounted on the link shaft 71 over which a recovering spring 74 is fitted. The transmission wheel 73 is provided with a neck slot 75. A bolt tool 76 is joined with a drive rod 80 which is provided with a pull cable 81. The drive rod 80 is provided in the middle thereof with a pivoting seat 82. A connection rod 83 is fastened pivotally with the drive rod 80 and a driven rod 90 which is provided with a pivoting seat 91, a press piece 92 which is provided with an adjustment bolt 93 opposite in location to a relieving rod 41 of the brake 40.

Figure 4:
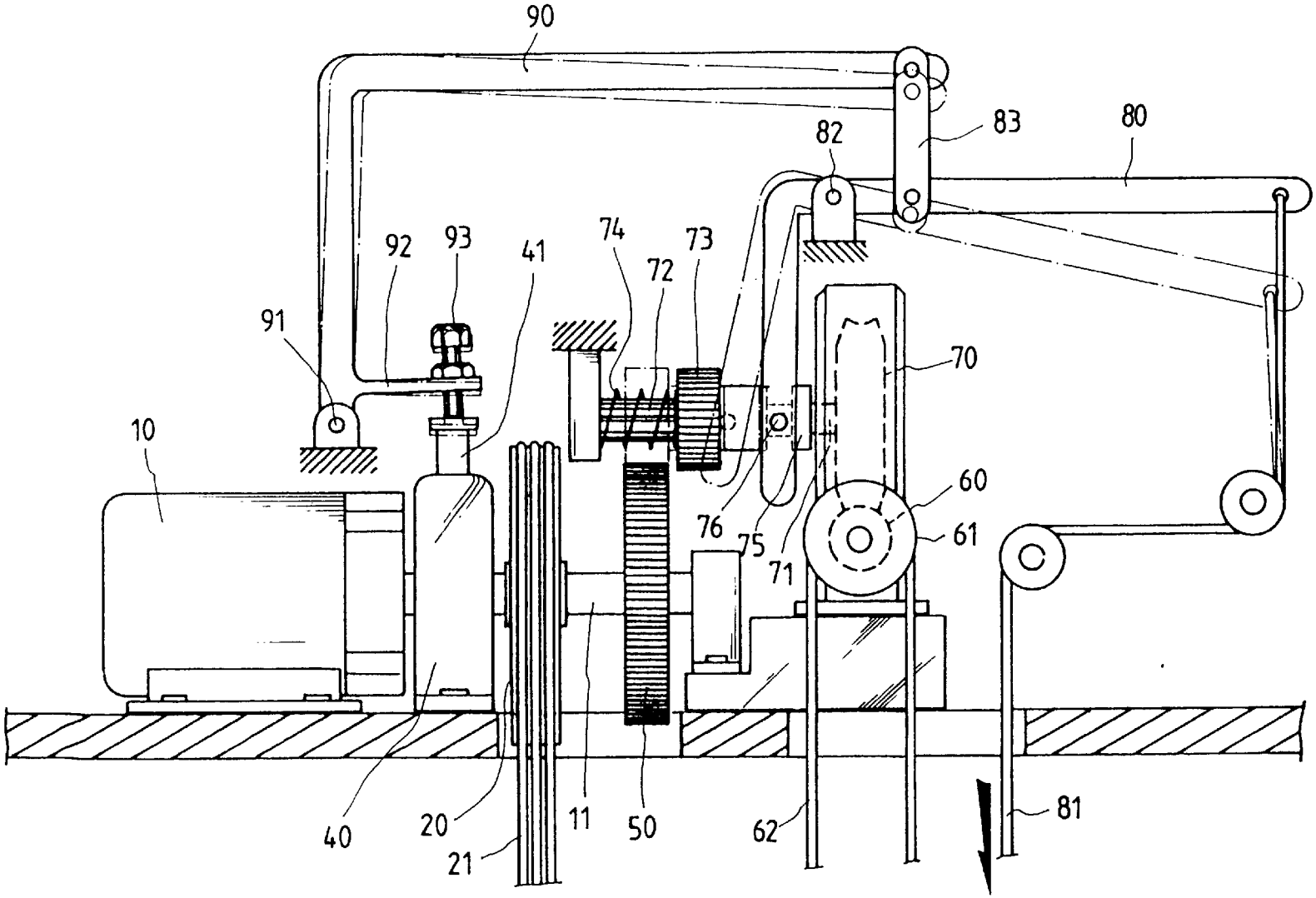
FIG. 4 shows a schematic view of the present invention in operation.

As shown in FIG. 4, when the pull cable 81 is pulled, the drive rod 80 is turned on the pivoting seat 82 serving as a fulcrum such that other end of the drive rod 80 actuates the transmission wheel 73 to displace along the direction of the longitudinal axis of the link shaft 71. The transmission wheel 73 is engaged with the spline 72 of the link shaft 71. In the meantime, the transmission wheel 73 is engaged with the action wheel 50. The transmission wheel 73 is actuated by the drive rod 80 to engage one half of the action wheel 50. The drive rod 80 swivels on the pivoting seat 82 serving as a fulcrum. The connection rod 83 is thus pulled to descend. The connection rod 83 pulls the driven rod 90, which is actuated to turn on the pivoting seat 82 serving as a fulcrum The adjustment bolt 93 of the press piece 92 of the driven rod 90 can adjust and turn relieving rod 41 of the brake 40 such that the relieving rod 41 descends so as to relieve the transmission shaft 11 of the braking effect of the brake 40. In view of the fact that the action wheel 50 is engaged with the transmission wheel 80, and that the transmission wheel 73 is engaged with the spline 72 of the link shaft 71 which is in turn engaged with the worm wheel 70, the worm wheel 70 can be acted on by the worm rod 60 to turn. The power imparted to the worm wheel 70 via the transmission shaft 11 is restricted by the worm rod 60. As a result, the elevator cab 30 remains stationary even if the transmission shaft 11 is relieved of the braking effect of the brake 40.

Figure 5:
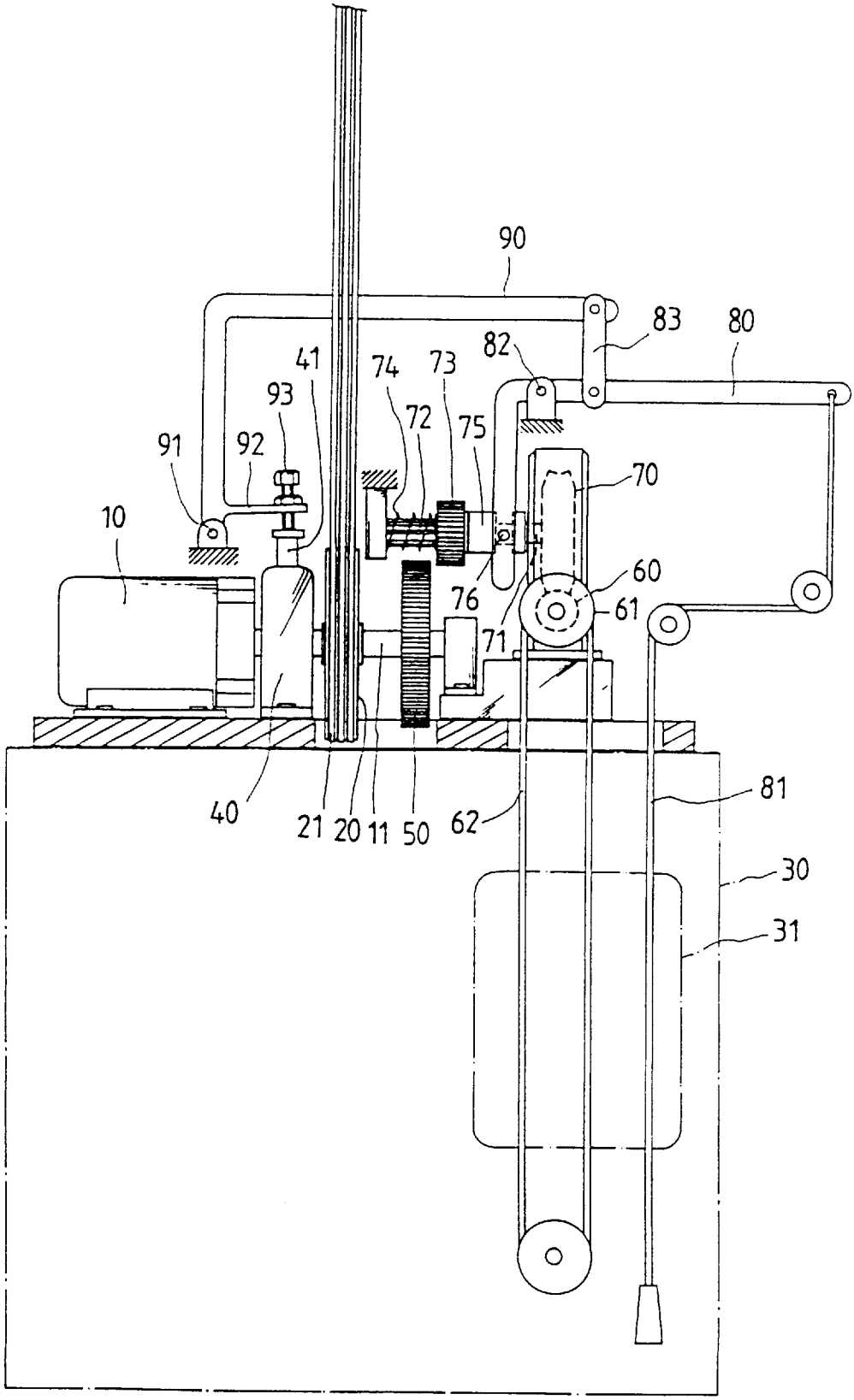
FIG. 5 shows a schematic view of the present invention mounted on top of an elevator cab.
Figure 6:
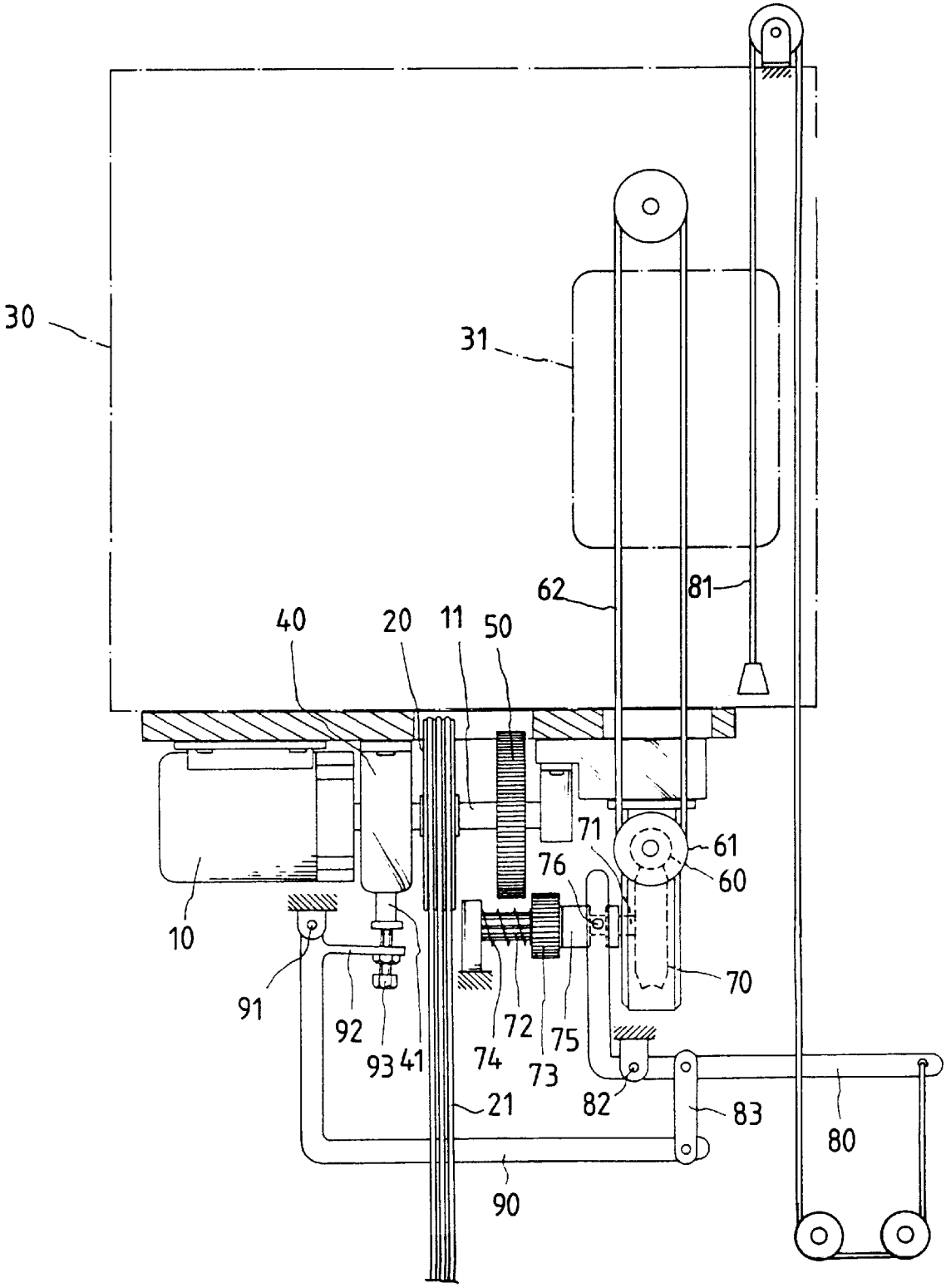
FIG. 6 shows a schematic view of the present invention mounted at the bottom of the elevator cab.

As shown in FIG. 5, the present invention may be mounted on the top of the elevator cab 30, so as to ascend or descend along with the elevator cab 30. The pull cable 81 and the action cable 62 are attached to the elevator cab 30 such that they are visible via a window 31 of the elevator cab 30.

Figure 7:
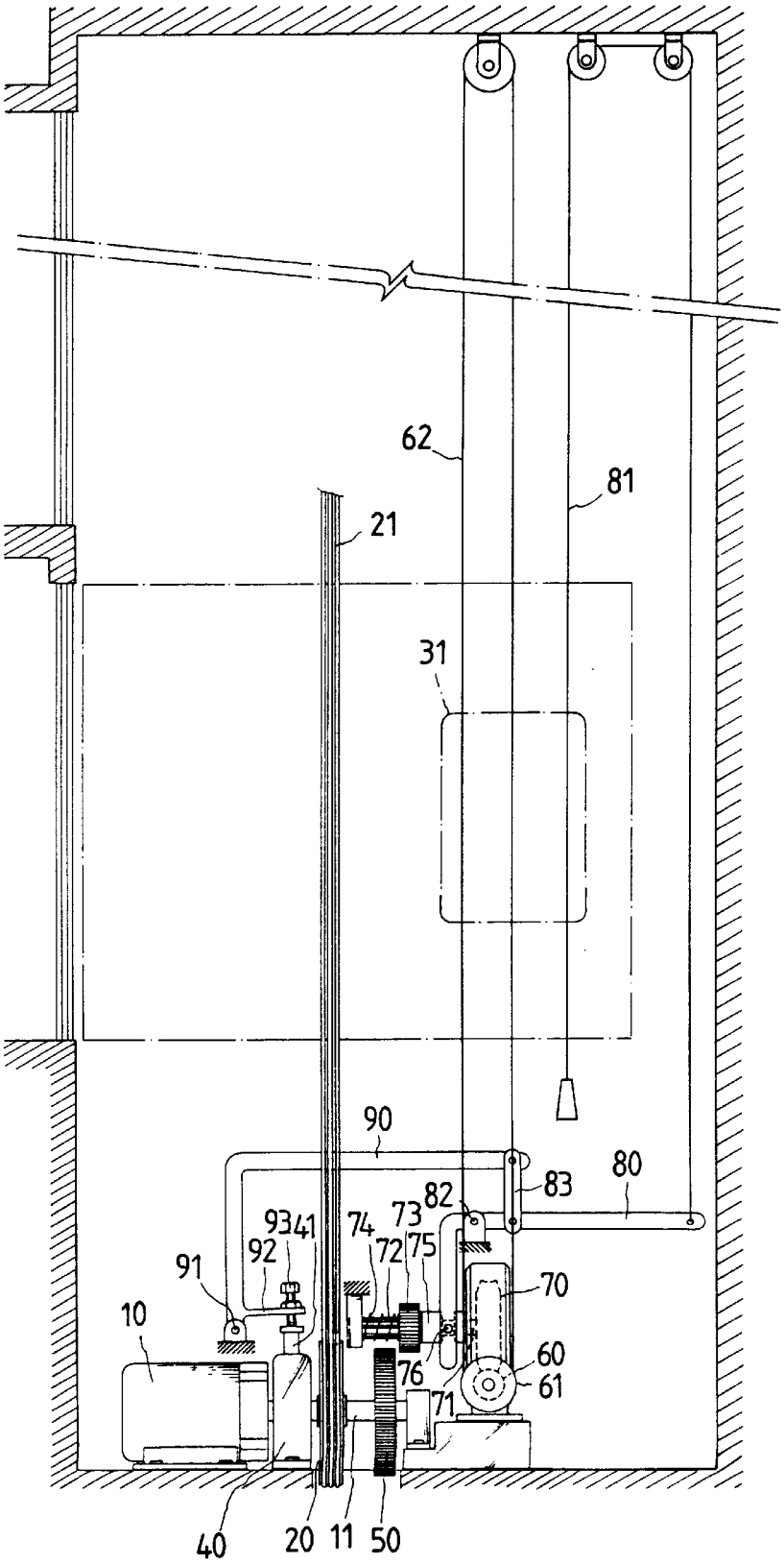
FIG. 7 shows a schematic view of the present invention located at the bottom of an elevator shaft.
Figure 8:
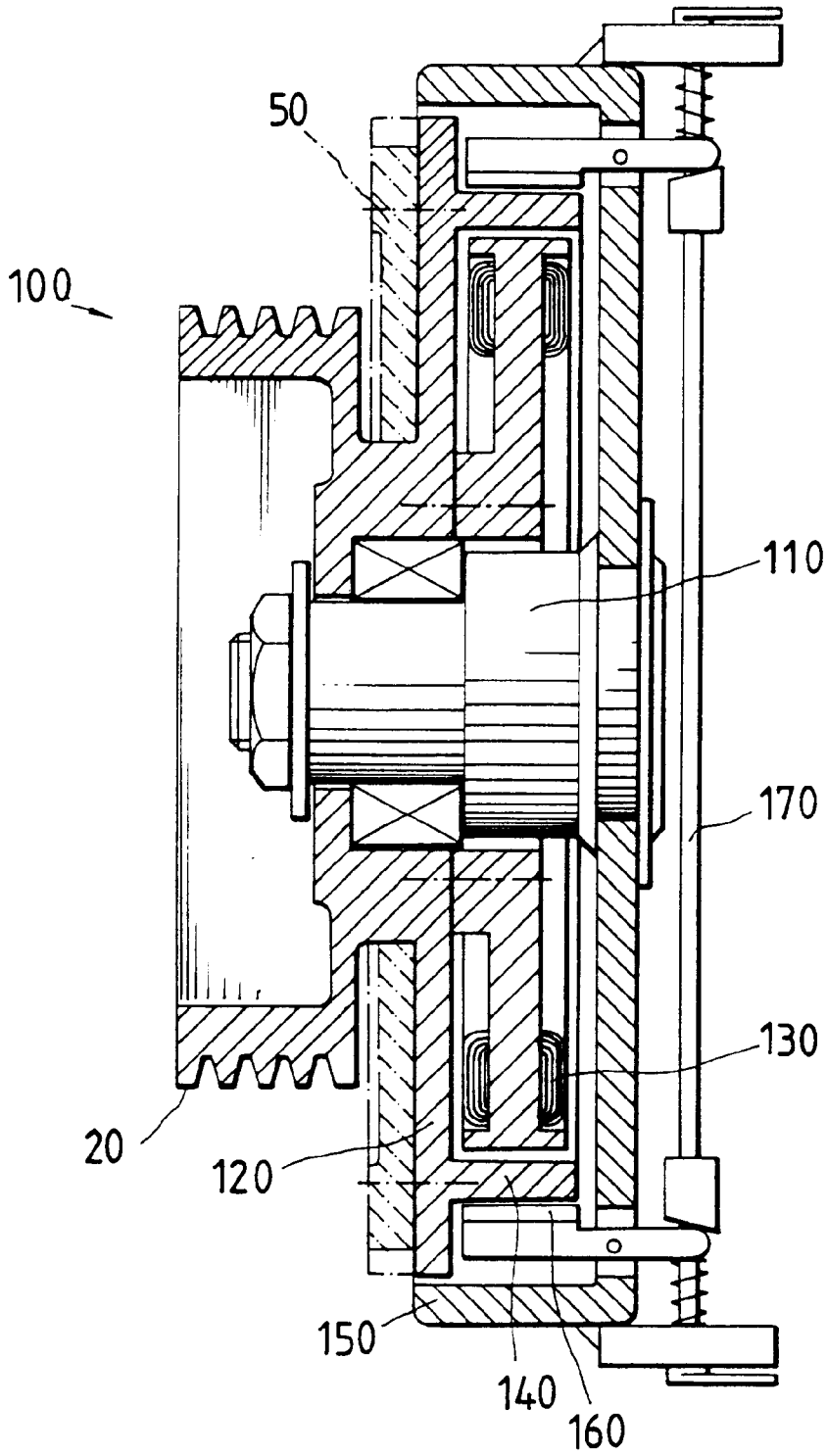
FIG. 8 shows a schematic plan view of the present invention in cooperation with the butterfly motor.
Figure 9:
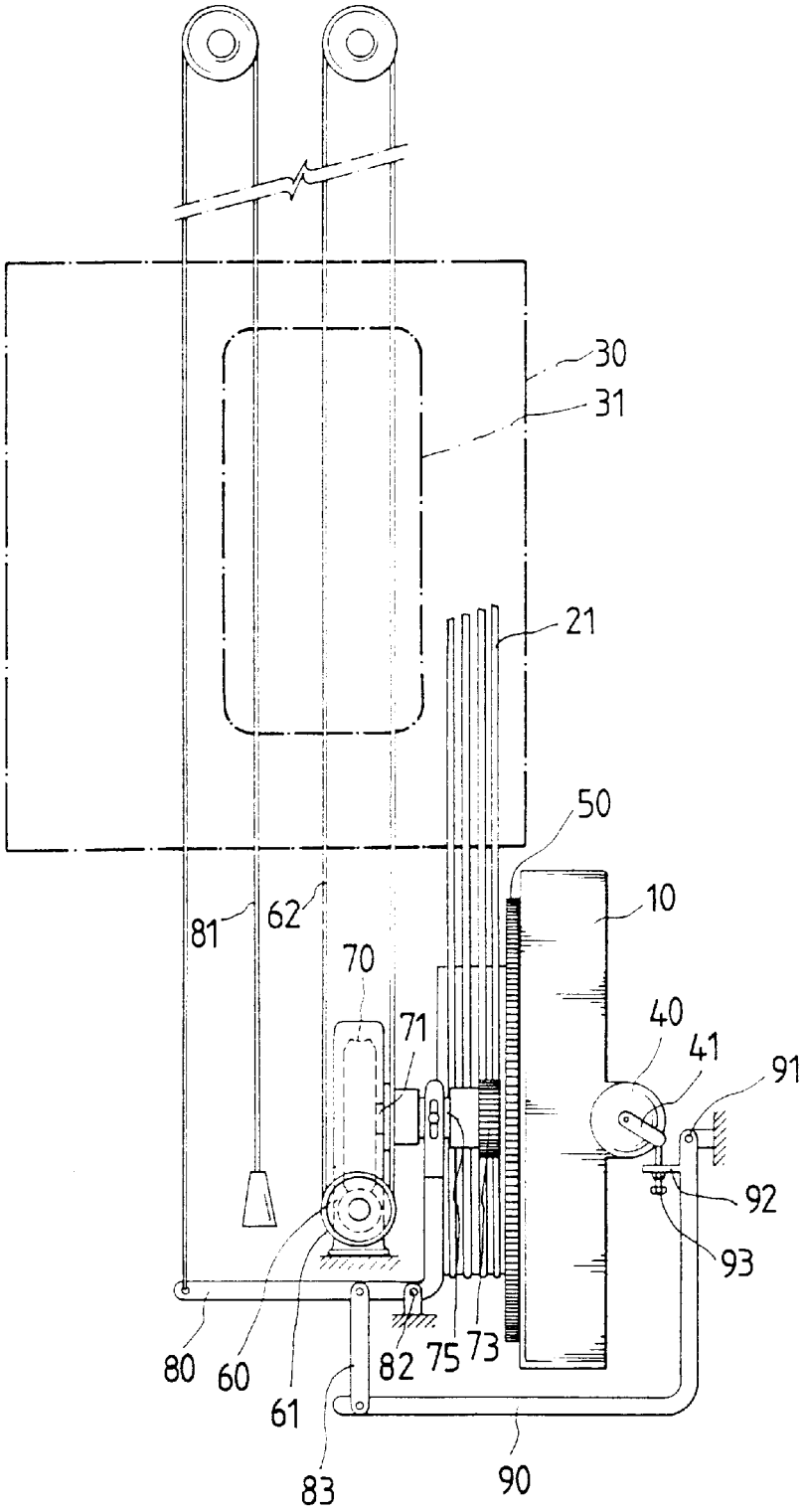
FIG. 9 shows a schematic plan view of the present invention in cooperation with the butterfly motor.

As shown in FIG. 7, the present invention may be disposed at the bottom of the elevator shaft such that the pull cable 81 and the action cable 62 can be acted on through the window 31 of the elevator cab 30, As shown in FIGS. 8 and 9, an elevator may be driven to ascend or descend by a butterfly motor 100, which is provided with a main shaft 110 which is in turn provided at one end thereof with an ascending-descending cable wheel 20. A permanent magnet mount 120 is located near one side of the cable wheel 20. The mount 120 is provided in the inner surface thereof with a permanent magnet 130. In conjunction with a frequency changing control, the main shaft 110 is effected on by the magnetic field induction such that the permanent magnet mount 120 actuates the cable wheel 20 to operate. The permanent magnet mount 120 is provided in one side thereof with a wall 140 which is covered by a shell 150 which is disposed at other end of the main shaft 110. Located between the wall 140 and the shell 150 is a brake shoe 160 which can be driven by an external force to arrest the wall 140 such that the cable wheel 20 is motion is halted. As shown in FIGS. 10 and 11, the outer side of the permanent magnet mount 120 of the motor 100 is provided with an action wheel. The brake 40 is located near the motor 100 such that the brake 40 can be controlled by a relieving rod 41 such that the permanent magnet mount 120 can be relieved of the braking effect of the brake 40. The action wheel 50 can be operated without power in view of the fact that the worm rod 60 is provided at one end thereof with a rotary wheel 61 on which the action able 62 is wound, and that the worm rod 60 is engaged with a worm wheel 70 which is provided with a linking shaft 71. The linking shaft 71 is provided at one end thereof with a spline 72. A transmission wheel 73 is mounted on the linking shaft 71 and fitted over by a recovering spring 74. The transmission wheel 73 is provided with a neck slot 75 which is engaged with a drive rod 80 by a bolt 76. The drive rod 80 is fastened at other end thereof with a pull cable 81. The drive rod 80 is provided in the midsegment thereof with a pivoting seat 82. The drive rod 80 is pivoted with a connection rod 83 which is fastened pivotally at other end thereof with a driven rod 90 which is provided at other end thereof with a pivoting seat 91, a press piece 92, and an adjustment bolt 93 opposite in location to the relieving rod 41 of the brake 40. In case of a power outage, the pull cable 81 can be pulled with hand via the window 31 of the elevator cab 30. As a result, the action cable 62 is actuated to drive the rotary wheel 61, as well as the worm rod 60, thereby actuating the worm wheel 70 and the lining shaft 71. The transmission wheel 73 is actuated by the spline 72 of the linking shaft wheel 71 such that the action wheel 50 and the cable wheel 20 are in operation, and that the cab cable 21 actuates the elevator cab 30 to ascend or descend slowly.

Now referring to FIGS. 12 and 13, the ascending and the ascending and the descending motions of the elevator are directly controlled by a frequency changing motor 200 which is mounted on the elevator cab 30 capable of a high speed motion. The motor 200 is provided at one end thereof with a cable wheel 20 and a cab cable 21 winding on the cable wheel 20 such that other end of the cab cable 21 is fastened with a weight 300 via an idle wheel 210. When the motor 200 actuates the cable wheel 20 to turn, the cab cable 21 is in motion. The elevator cab 30 is capable of a fast motion due to the weight 3000 and the weight of the elevator cab 30. However, the elevator cab 30 in motion is slowed down to a gradual halt, thanks to the frequency changing action of the motor 200. In light of the cab cable 21 being wound on the cable wheel 20 and the idle wheel 210 being located at the midpoint, the elevator cab 30 is often so stopped that the floor of the elevator cab 30 is not precisely flush with the floor surface of a specific floor of the building. The is due to the fact that the cable wheel 20 has already stopped at the time when the elevator cab 30 is about to stop, and that the cab cable 21 continues moving on the idle wheel 210. The idle wheel 210 is provided with a main shaft 211 on which the brake 40 and the action wheel 50 are mounted. As a result, the idle wheel 210 in motion can be arrested by the brake 40 at the time when the elevator cab 30 has come to a halt. In other word, the residual motion of the cab cable 21 on the cab wheel 20 is effectively eliminated such that the floor of the elevator cab 30 is always flush with the floor surface of a specific floor at which the elevator cab 30 is stopped. In case of a power outage, the action wheel 50 can be activated by pulling the pull cable 81, as shown in FIG. 14, so as to actuate the drive rod 80 to swivel on the pivoting seat 82 serving as a fulcrum. The transmission wheel 73 is thus actuated by other end of the drive rod 80 such that the transmission wheel 73 is caused to displace along the longitudinal direction of the linking shaft 71. The spline slot 76 of the transmission wheel 73 is engaged with the spline teeth 72 of the linking shaft 71. In the meantime, transmission wheel 73 is engaged with the action wheel 50. The transmission wheel 73 is moved by the drive rod 80 to mesh with one half of the action wheel 50. The connection rod 83 is pulled to descend, due to the drive rod 80 which swivels on the pivoting seat 82 serving as a fulcrum. The adjustment bolt 93 of the press piece 92 of the driven rod 90 is used to adjust the relieving rod 41.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An elevator provided with an emergency escape device consisting of a planetary motor mounted in an elevator mechanical control room to serve as a main power source for an elevator cab to ascend or descend, said motor provided with a transmission shaft which is linked with a cable wheel for winding a cab cable capable of actuating the elevator cab, said transmission shaft provided with a brake and an action wheel which is provided with a driving and protecting structure, said driving and protecting structure provided with a worm rod which is provided at one end thereof with a rotary wheel on which an action cable is wound, said worm rod being engaged with a worm wheel provided with a lining shaft which is in turn provided with a spline, said linking shaft provided with a transmission wheel and a recovery spring, said transmission wheel provided with a neck slot, a bolt tool being joined with a drive rod which is provided with a pull cable, and a pivoting seat, a connection rod fastened pivotally with said drive rod and a driven rod which is provided with a pivoting seat, a press piece provided with an adjustment bolt opposite in location to a relieving rod of the brake, said drive rod capable of turning on said pivoting seat at the time when said pull cable is pulled, thereby causing said drive rod to actuate said transmission wheel to displace along the direction of a longitudinal axis of said linking shaft, said transmission wheel being engaged with said spline of said linking shaft, and said action wheel, said transmission wheel being actuated by said drive rod to engage said action wheel, thereby causing said connection rod to descend, said relieving rod of said brake being adjusted by said adjustment bolt of said driven rod such that said relieving rod descends to relieve said transmission shaft of a braking effect of said brake, said elevator cab remaining stationary at the time when said transmission shaft is relieved of the braking effect of said brake, due to the fact that power imparted to said worm wheel via said transmission shaft is restricted by said worm rod.

2. The elevator as defined in claim 1, wherein said cab cable is wound on said cable wheel such that an other end of said cab cable is fastened with a weight via an idle wheel which is provided with a main shaft on which said brake and said action wheel are mounted, said main shaft of said idle wheel being relieved of said brake at the time when said pull cable is pulled; wherein said rotary wheel is actuated by said action cable so as to actuate said linking shaft via said worm wheel, thereby resulting in the imparting of motion from said driven wheel to said action wheel, and in the actuating of said cab cable by said cable wheel.

* * * * *